US012426769B2

(12) United States Patent
Neal

(10) Patent No.: US 12,426,769 B2
(45) Date of Patent: Sep. 30, 2025

(54) FOOTWEAR WASHING ASSEMBLY

(71) Applicant: Tazanna Neal, Henri Giraud Vente (FR)

(72) Inventor: Tazanna Neal, Henri Giraud Vente (FR)

( * ) Notice: Subject to any disclaimer, the term of this patent is extended or adjusted under 35 U.S.C. 154(b) by 350 days.

(21) Appl. No.: 18/142,399

(22) Filed: May 2, 2023

(65) Prior Publication Data

US 2024/0366059 A1 Nov. 7, 2024

(51) Int. Cl.

| | |
|---|---|
| ***A47L 23/00*** | (2006.01) |
| ***A46B 5/00*** | (2006.01) |
| ***A46B 9/06*** | (2006.01) |
| ***A46B 13/00*** | (2006.01) |
| ***A46B 13/02*** | (2006.01) |
| ***A46B 15/00*** | (2006.01) |
| ***A47L 23/02*** | (2006.01) |
| ***A47L 23/18*** | (2006.01) |
| ***A47L 23/20*** | (2006.01) |
| ***B65D 25/04*** | (2006.01) |
| ***B65D 43/16*** | (2006.01) |
| ***B65D 43/26*** | (2006.01) |
| *A46B 11/06* | (2006.01) |
| *A47L 23/26* | (2006.01) |

(52) U.S. Cl.

CPC ..... *A47L 23/02* (2013.01); *A46B 5/0004* (2013.01); *A46B 9/06* (2013.01); *A46B 13/008* (2013.01); *A46B 13/02* (2013.01); *A46B 15/0004* (2013.01); *A47L 23/18* (2013.01); *A47L 23/20* (2013.01); *B65D 25/04* (2013.01); *B65D 43/163* (2013.01); *B65D 43/26* (2013.01); *A46B 11/06* (2013.01); *A46B 2200/306* (2013.01); *A47L 23/26* (2013.01)

(58) Field of Classification Search

CPC ..... A47L 23/00; A47L 23/20; A47L 23/26; A46B 13/02; A46B 11/06; A46B 15/00; A47K 7/04

USPC ..... 15/160, 176.1, 227

See application file for complete search history.

(56) References Cited

U.S. PATENT DOCUMENTS

| | | | | |
|---|---|---|---|---|
| D370,318 | S | 5/1996 | Molina | |
| 5,551,114 | A * | 9/1996 | Lee | A47L 23/06 15/97.1 |
| 8,161,590 | B2 | 4/2012 | Feeg | |
| 8,584,293 | B1 | 11/2013 | Arnal | |
| 9,049,978 | B1 | 6/2015 | Shamberger | |

(Continued)

FOREIGN PATENT DOCUMENTS

| | | |
|---|---|---|
| CA | 2849219 | 10/2015 |

*Primary Examiner* — Michael D Jennings

(57) ABSTRACT

A footwear washing assembly for automatically washing a pair of shoes includes a washing box to insertably receive a pair of shoes for washing the pair of shoes. A water reservoir is removably attachable to the washing box to contain water for washing the shoes in the washing box and a detergent reservoir is removably attachable to the washing box to contain detergent for washing the shoes in the washing box. A plurality of basal scrubbers and a plurality of lateral scrubbers are each movably integrated into the washing box for scrubbing a sole of the shoes. A plurality of rollers is pivotally attached to the washing box to roll along the support surface. Additionally, a pair of stands is pivotally attached to the washing to support the washing box above the support surface.

18 Claims, 8 Drawing Sheets

(56) References Cited

U.S. PATENT DOCUMENTS

| | | | | |
|---|---|---|---|---|
| 9,161,678 | B1 | 10/2015 | Thompson | |
| 9,603,504 | B2 | 3/2017 | Cruz | |
| 9,609,984 | B1 * | 4/2017 | Kelly | A47K 7/04 |
| 9,661,983 | B1 * | 5/2017 | Gonzales | A47L 23/26 |
| 10,426,316 | B2 | 10/2019 | Gold | |
| 10,617,264 | B1 * | 4/2020 | Sookdeo | A47K 7/03 |
| 11,752,526 | B1 * | 9/2023 | Strickland | B08B 3/02 15/36 |
| 2003/0172488 | A1 * | 9/2003 | Jeffries | A47L 23/02 15/308 |
| 2022/0118137 | A1 * | 4/2022 | McKeon | A61L 2/24 |

* cited by examiner

FOOTWEAR WASHING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to washing devices and more particularly pertains to a new washing device for washing the soles of shoes when the shoes have been worn outdoors. The device includes a washing box and a plurality of scrubbers strategically positioned in the washing device for washing soles of shoes that are place in the washing box. The device includes a water and detergent delivery system for enhancing washing the shoes, a drain for collecting the water and detergent and a plurality of blowers for drying the shoes. The device has electronic controls that automatically open lids of the washing box and controls washing cycles for the washing box.

(2) Description of Related Art Including Information Disclosed Under 37 CFR 1.97 and 1.98

The prior art relates to washing devices including a variety of shoe cleaning devices that each includes a unique cleaning element that is exposed such that a user can place their foot on the cleaner while wearing a shoe for cleaning a sole of the shoe. In each instance the shoe is exposed while the shoe is being cleaned. In no instance does the prior art disclose a shoe cleaner that includes a box into which a pair of shoes can be enclosed and a plurality of cleaning brushes rotatably disposed in the box for cleaning the pair of shoes.

BRIEF SUMMARY OF THE INVENTION

An embodiment of the disclosure meets the needs presented above by generally comprising a washing box to insertably receive a pair of shoes for washing the pair of shoes. A water reservoir is removably attachable to the washing box to contain water for washing the shoes in the washing box and a detergent reservoir is removably attachable to the washing box to contain detergent for washing the shoes in the washing box.

A plurality of basal scrubbers and a plurality of lateral scrubbers are each movably integrated into the washing box for scrubbing a sole of the shoes. A plurality of rollers is pivotally attached to the washing box to roll along the support surface. Additionally, a pair of stands is pivotally attached to the washing to support the washing box above the support surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
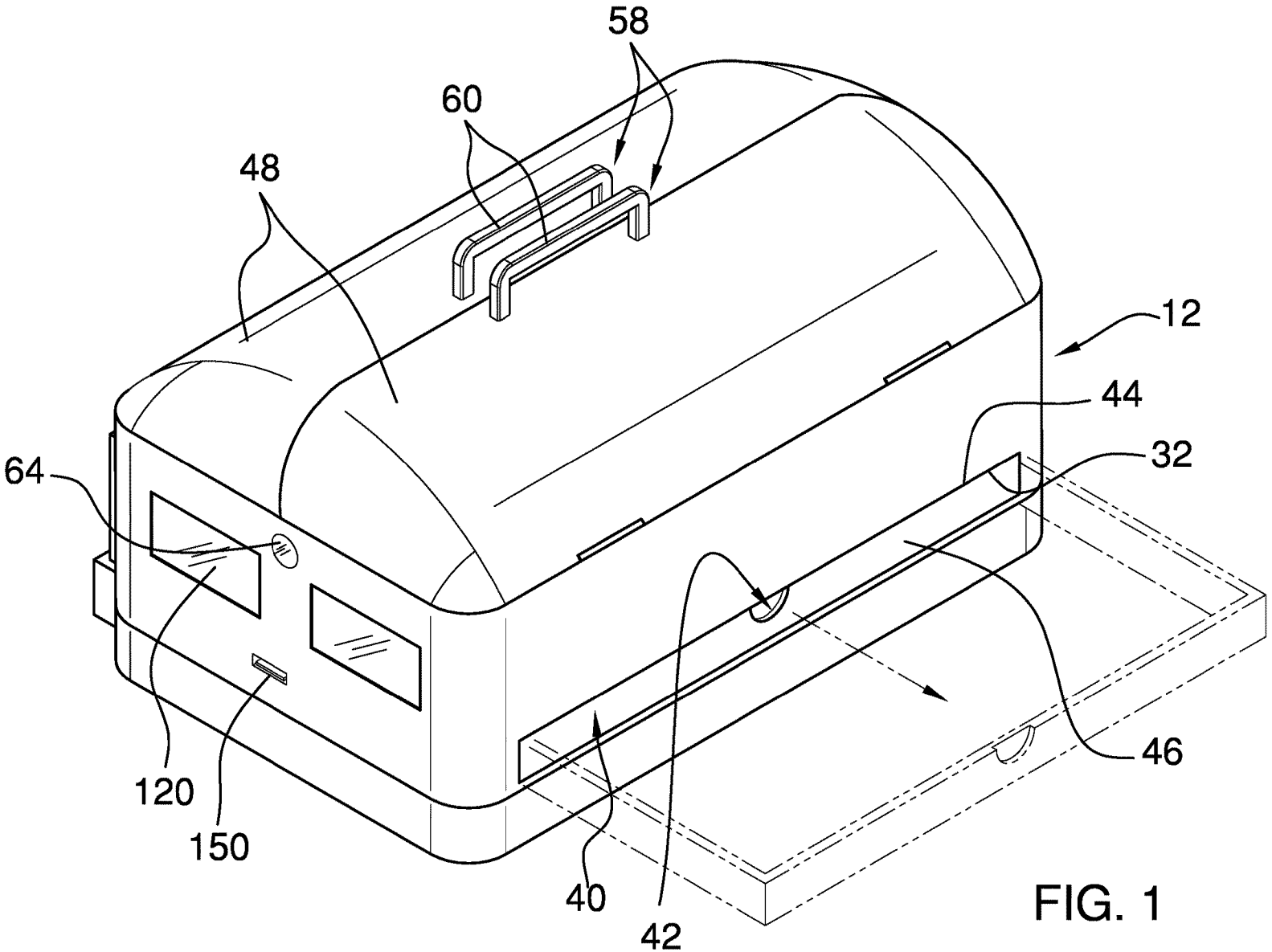
FIG. 1 is a front perspective view of a footwear washing assembly according to an embodiment of the disclosure.
Figure 2:
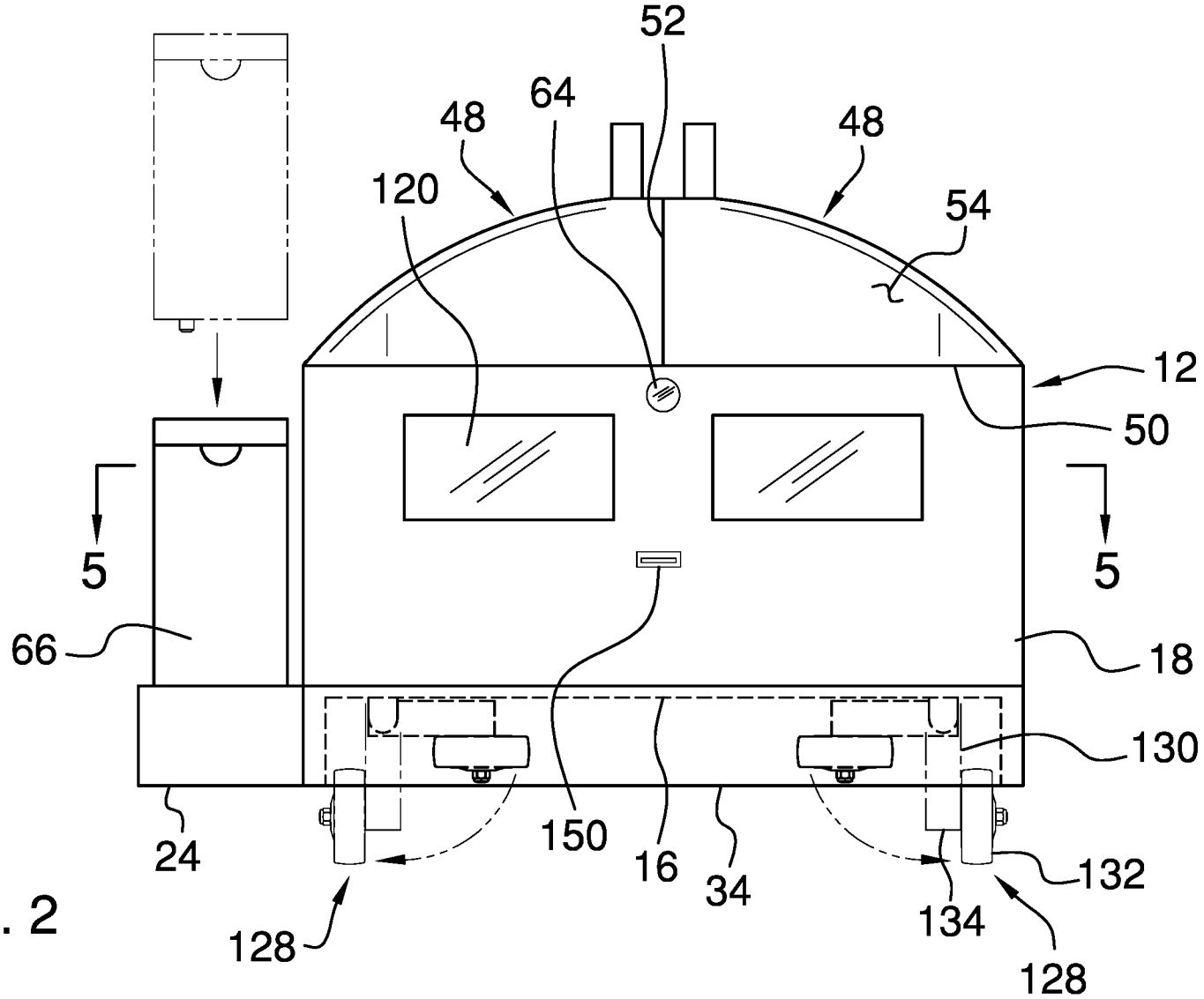
FIG. 2 is a front phantom view of an embodiment of the disclosure.
Figure 3:
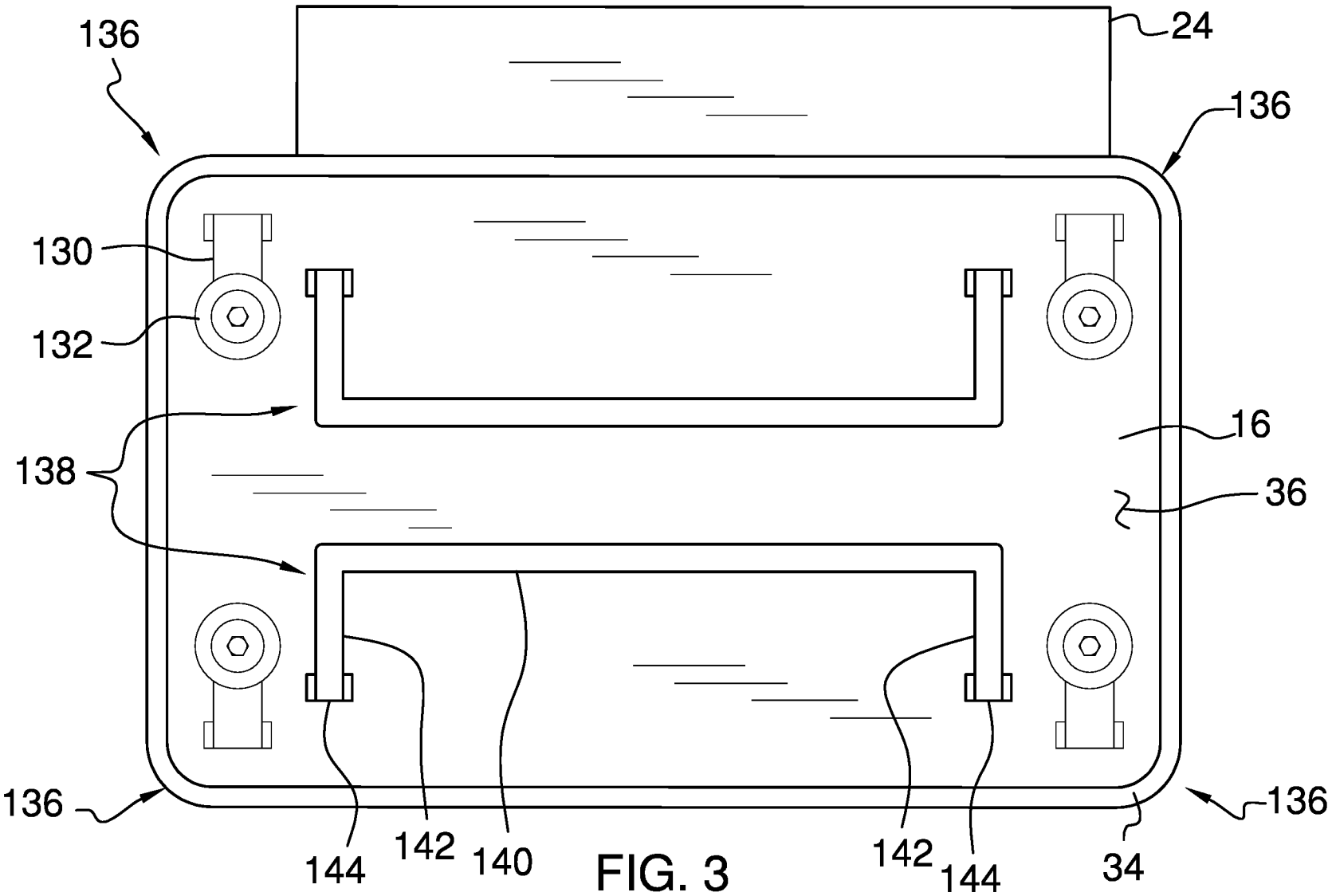
FIG. 3 is a bottom view of an embodiment of the disclosure.
Figure 4:
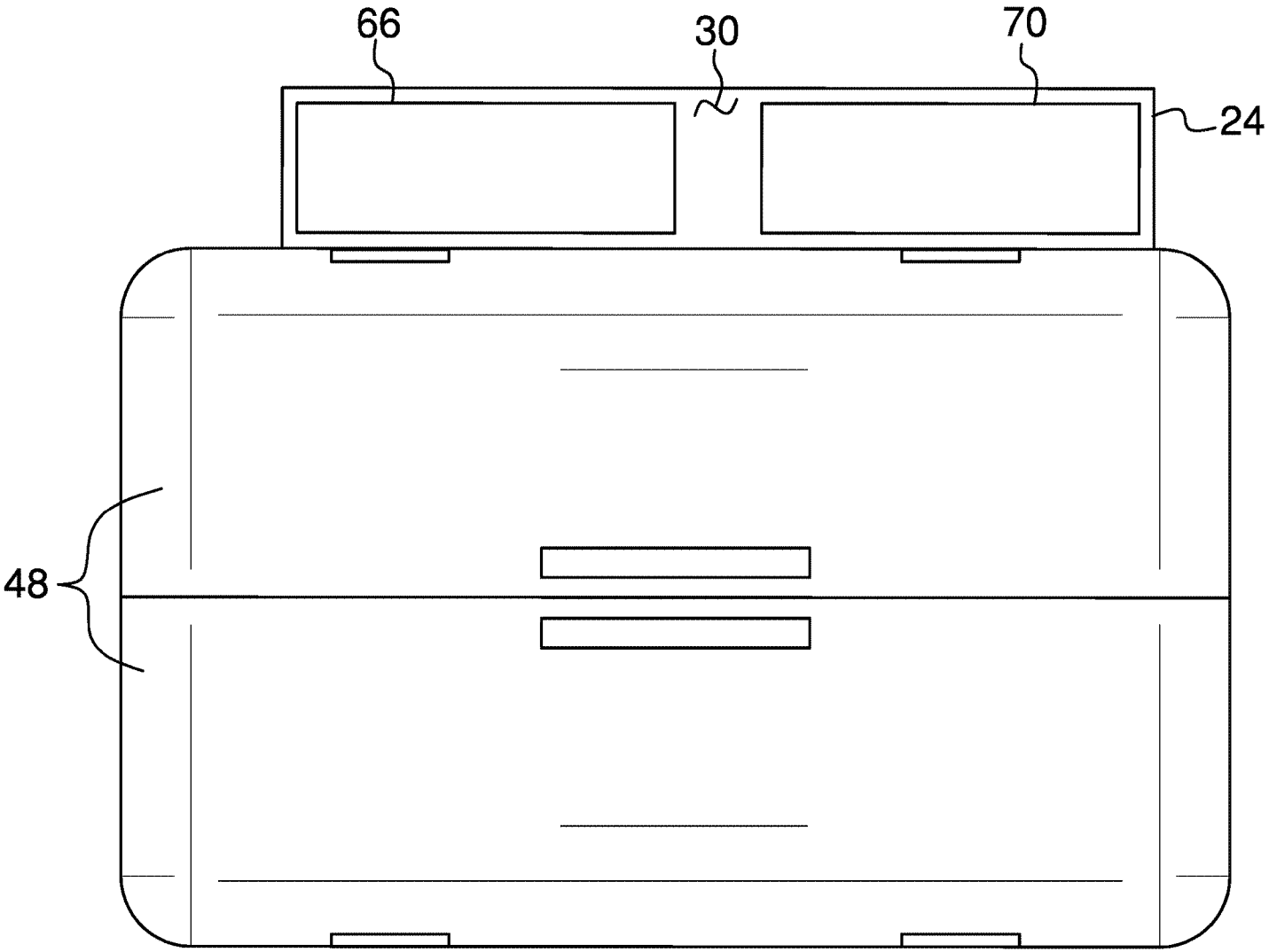
FIG. 4 is a top view of an embodiment of the disclosure.
Figure 5:
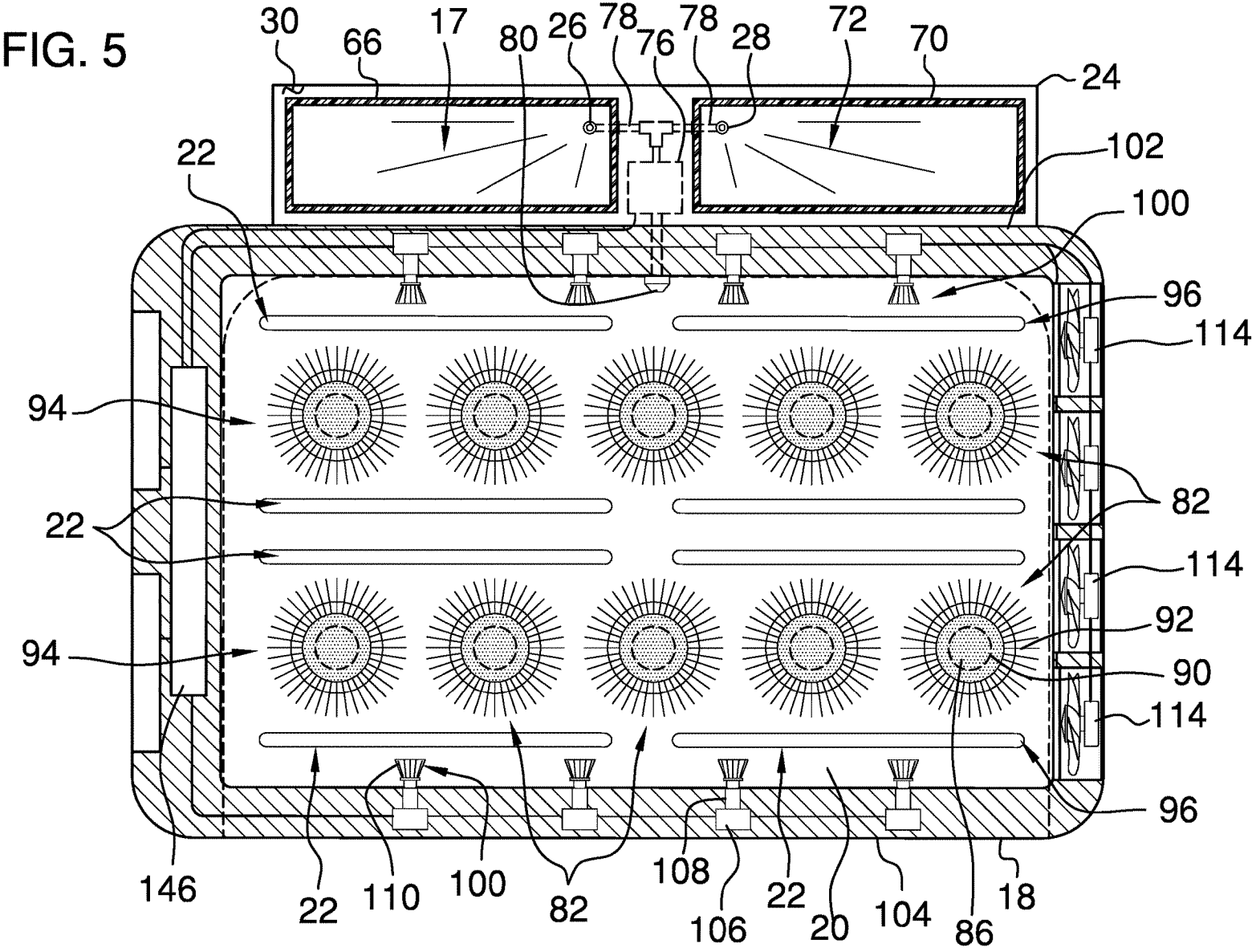
FIG. 5 is a cross sectional view taken along line 5-5 of FIG. 2 of an embodiment of the disclosure.
Figure 6:
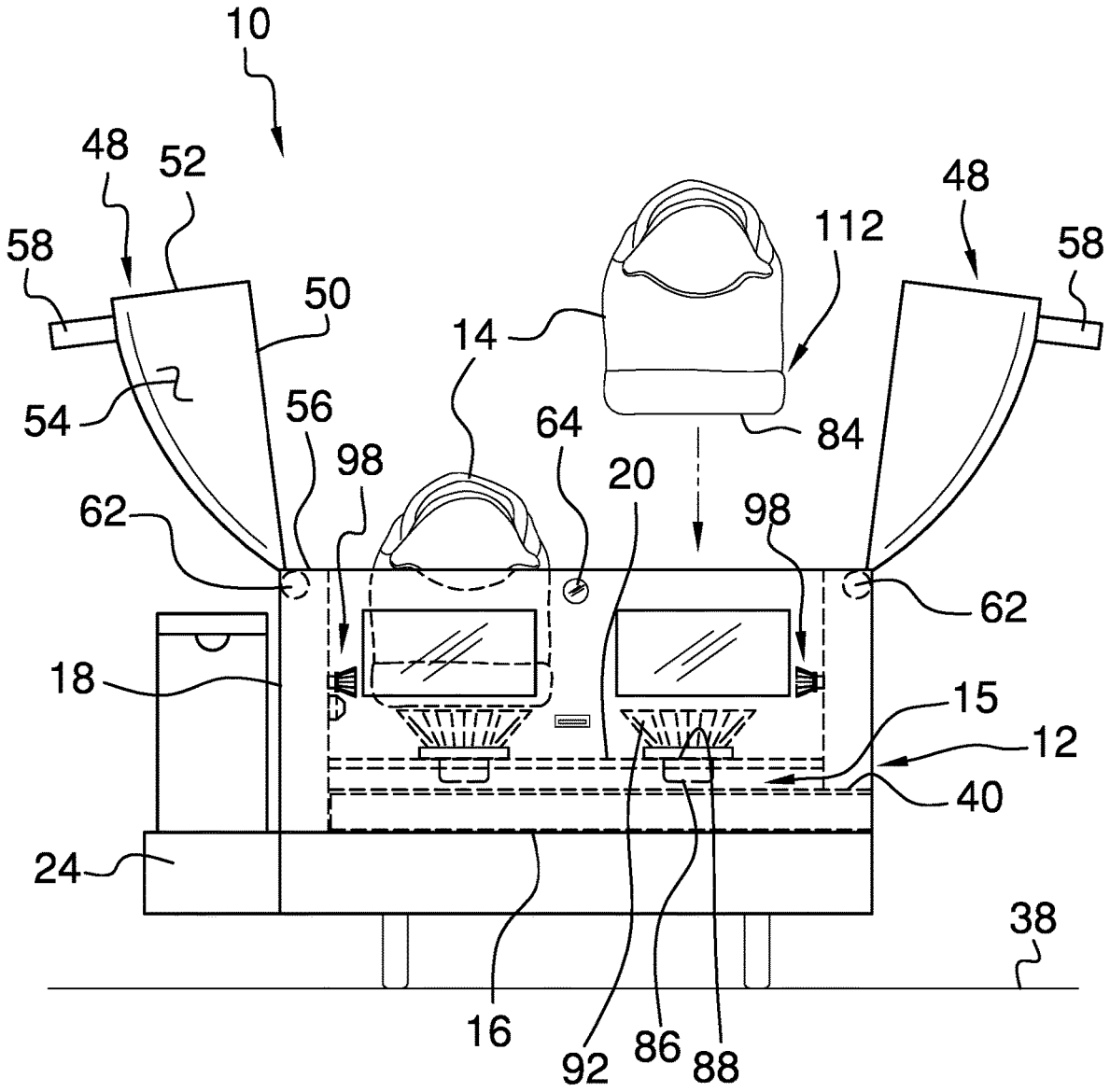
FIG. 6 is a phantom in-use view of an embodiment of the disclosure.
Figure 7:
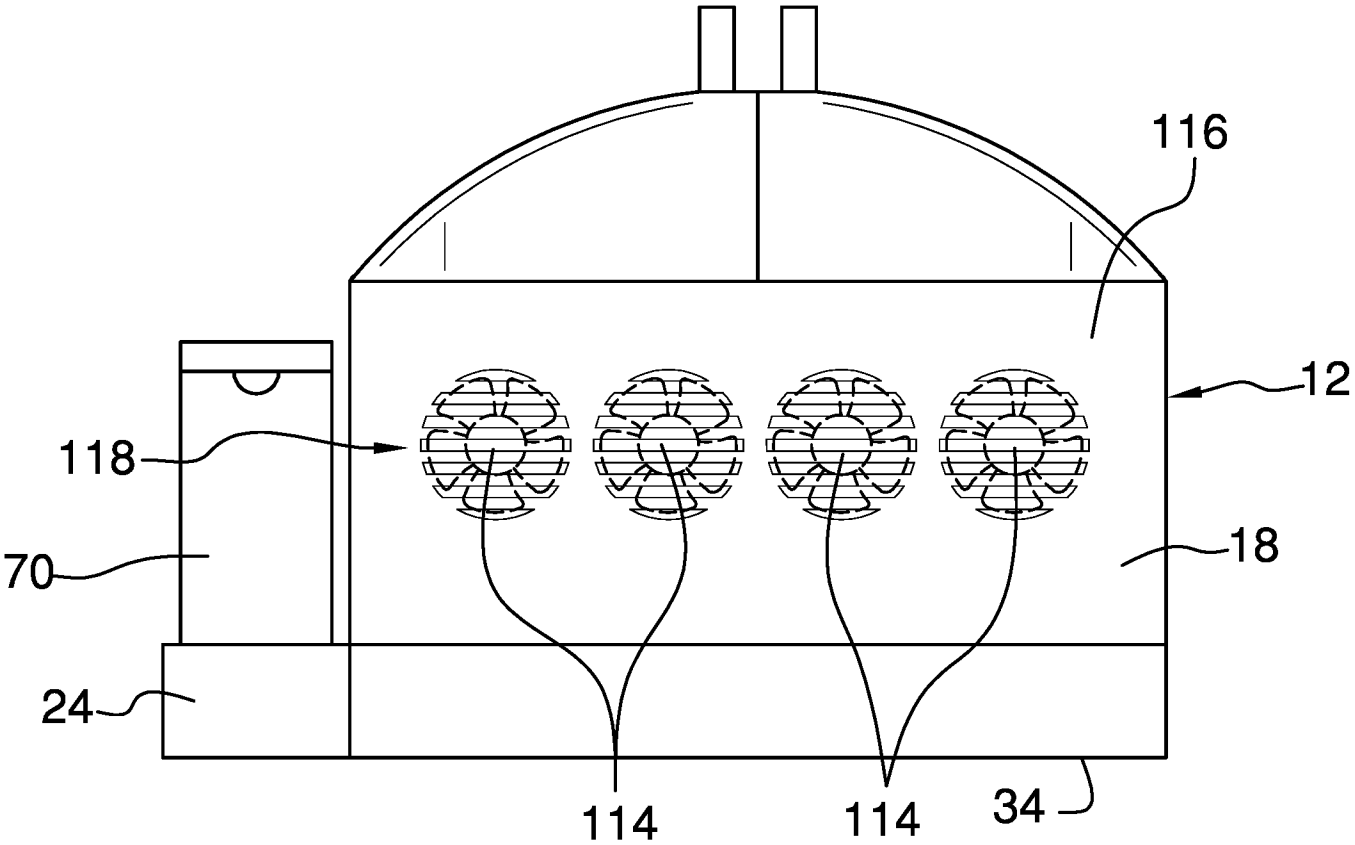
FIG. 7 is a back view of an embodiment of the disclosure.
Figure 8:
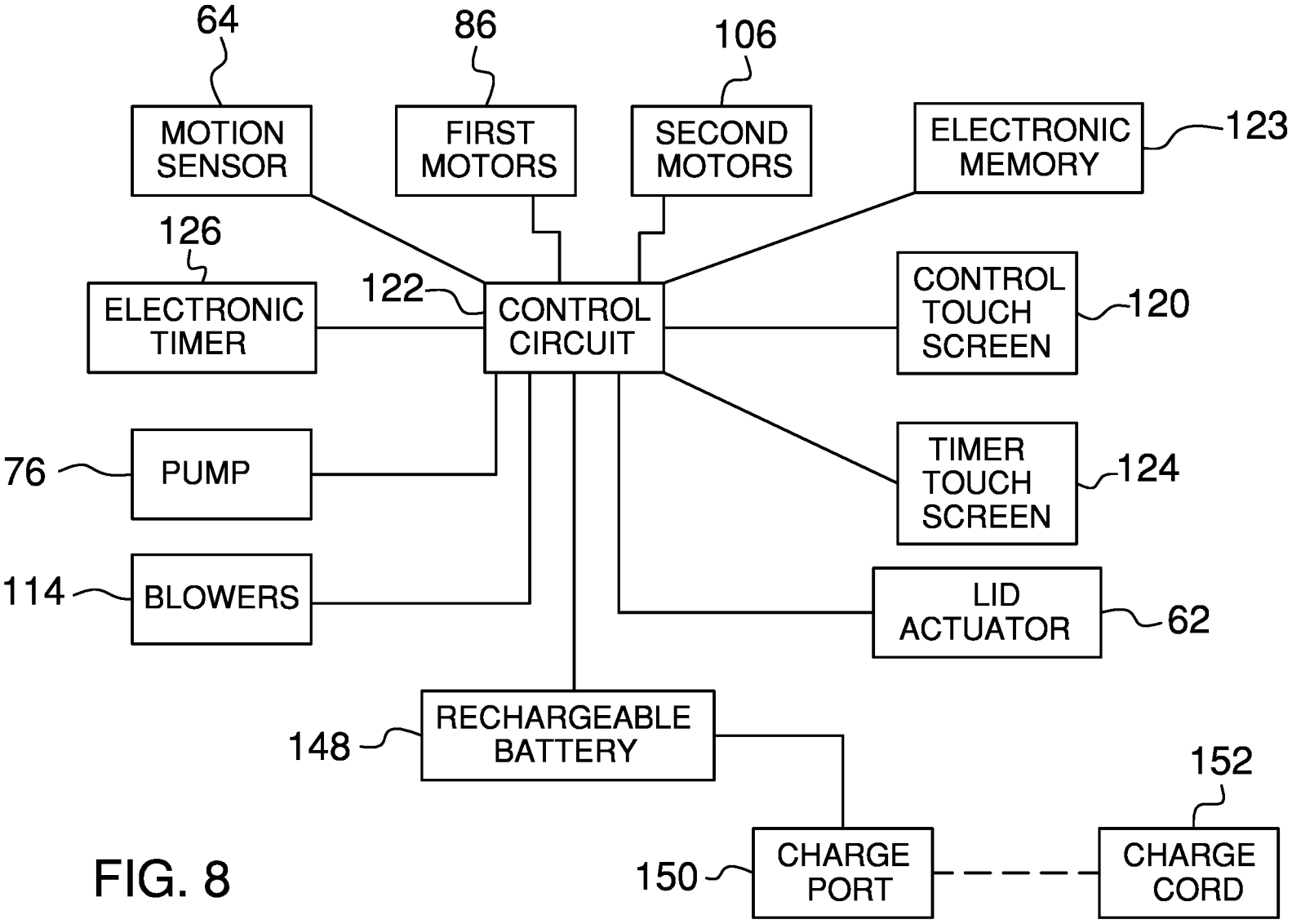
FIG. 8 is a schematic view of an embodiment of the disclosure.

With reference now to the drawings, and in particular to FIGS. 1 through 8 thereof, a new washing device embodying the principles and concepts of an embodiment of the disclosure and generally designated by the reference numeral 10 will be described.

As best illustrated in FIGS. 1 through 8, the footwear washing assembly 10 generally comprises a washing box 12 that can insertably receive a pair of shoes 14. The washing box 12 has a fluid compartment 15 that is integrated into the washing box 12 to receive water 17 that is introduced into the washing box 12 for washing the pair of shoes 14. The washing box 12 has a bottom wall 16 and a perimeter wall 18 extending upwardly from the bottom wall 16 and the washing box 12 has a dividing wall 20 that is spaced from and is oriented parallel to the bottom wall 16. Furthermore, the dividing wall 20 defines the fluid compartment 15 between the dividing wall 20 and the bottom wall 16. The dividing wall 20 has a plurality of slots 22 extending through the dividing wall 20 to drain the water 17 into the fluid compartment 15.

The washing box 12 has a tray 24 extending laterally away from the perimeter wall 18 of the washing box 12. The tray 24 has a water input 26 and a detergent input 28 each being integrated into a top surface 30 of the tray 24. The perimeter wall 18 has a drawer opening 32 extending into the fluid compartment 15 and the washing box 12 has a lip 34 extending downwardly from a bottom surface 36 of the bottom wall 16 which rests on a support surface 38 when the washing box 12 is positioned on the support surface 38. Additionally, the lip 34 is aligned with the perimeter wall 18 having the lip 34 surrounding the bottom wall 16.

A drawer 40 is slidable into the drawer opening 32 in the perimeter wall 18 of the washing box 12 thereby facilitating the drawer 40 to be positioned in the fluid compartment 15. In this way the drawer 40 can capture the water 17 that drains through the dividing wall 20. The drawer 40 is removable from the drawer opening 32 to facilitate the water 17 to be emptied from the drawer 40. A cut-out 42 extends downwardly in an upper edge 44 of a front wall 46 of the drawer 40 for gripping to open the drawer 40 when the drawer 40 is closed.

A pair of lids 48 is each pivotally attached to the washing box 12 and each of the pair of lids 48 is positionable between a closed position and an open position. Each of the pair of lids 48 has a bottom edge 50 which intersects a front edge 52 at a perpendicular angle and an outer surface 54 that is concavely arcuate with respect to the bottom edge 50 such that each of the pair of lids 48 defines a half-shell. The bottom edge 50 of each of the pair of lids 48 is hingedly coupled to a top edge 56 of the perimeter wall 18 of the washing box 12 at a point located at an intersection with the outer surface 54 of the lids 48. The bottom surface 36 of each of the pair of lids 48 rests on the top edge 56 of the perimeter wall 18 having the front edge 52 of each of the pair of lids 48 abutting each other when the lids 48 are closed. The bottom edge 50 of each of the pair of lids 48 extends upwardly from the top edge 56 of the perimeter wall 18 when the lids 48 are opened.

A pair of handles 58 is each attached to a respective one of the pair of lids 48 to facilitate the washing box 12 to be carried. Each of the handles 58 includes a grip 60 that is spaced from the outer surface 54 of the respective lid 48 thereby facilitating the grip 60 to be gripped. The grip 60 associated with each of the handles 58 is oriented parallel with the front edge 52 of the respective lid 48. A pair of lid actuators 62 is each integrated into the perimeter wall 18 of the washing box 12 and each of the lid actuators 62 is in mechanical communication with the bottom edge 50 of a respective one of the lids 48. Each of the lid actuators 62 is actuatable into an opening condition for urging the pair of lids 48 into an open position. Conversely, each of the lid actuators 62 is actuatable into a closing condition for urging the pair of lids 48 into a closed position.

A motion sensor 64 is integrated into the perimeter wall 18 of the washing box 12 to sense motion near the washing box 12 and the motion sensor 64 is electrically coupled to each of the pair of lid actuators 62. Each of the lid actuators 62 is actuated into the opening condition when the motion sensor 64 senses motion to facilitate the pair of shoes 14 to be placed into the washing box 12. Each of the pair of lid actuators 62 is actuated into the closing condition a predetermined duration of time after the pair of lid actuators 62 is actuated into the opening condition. Additionally, each of the lid actuators 62 may comprise an electric motor or other similar device that can produce rotational torque.

A water reservoir 66 is attached to the washing box 12 to contain water 17 for washing the shoes 14 in the washing box 12. The water reservoir 66 is in fluid communication with the water input 26 on the top surface 30 of the tray 24 such that the water input 26 receives the water 17 from the water reservoir 66. A detergent reservoir 70 is attached to the washing box 12 to contain detergent 72 for washing the shoes 14 in the washing box 12. The detergent reservoir 70 is in fluid communication with the detergent input 28 on the top surface 30 of the tray 24 such that the detergent input 28 receives the detergent 72 from the detergent reservoir 70.

A pump 76 is integrated into the washing box 12 and the pump 76 has a pair of inputs 78 and an output 80 extending into an interior of the washing box 12. Each of the inputs 78 of the pump 76 is fluidly coupled to a respective one of the water input 26 and the detergent input 28 in the tray 24 to spray the water 17 and the detergent 72 outwardly through the output 80 of the pump 76 and into the washing box 12. The pump 76 may comprise an electric water pump or the like.

A plurality of basal scrubbers 82 is provided and each of the plurality basal scrubbers 82 is movably integrated into the washing box 12 to have the shoes 14 positioned on top of the plurality of basal scrubbers 82 when the shoes 14 are positioned in the washing box 12. The plurality of basal scrubbers 82 is actuatable into a scrubbing condition to scrub a sole 84 of the shoes 14. Each of the plurality of basal scrubbers 82 comprises a first motor 86 that is integrated into the dividing wall 20 of the washing box 12 such that an output shaft 88 of the first motor 86 extends upwardly from the dividing wall 20. The first motor 86 rotates in a first direction when the first motor 86 is turned on and the first motor 86 may comprise an electric motor or the like.

Each of the basal scrubbers 82 includes a set of first bristles 90 coupled to the output shaft 88 such that the first bristles 90 abuts the sole 84 of a respective shoe 14. Each of the set of first bristles 90 is comprised of a rigid material, including but not being limited to steel or aluminum, to dislodge mud and rocks from the sole 84 of the respective shoe 14 when the first motor 86 is turned on. Each of the basal scrubbers 82 includes a set of second bristles 92 coupled to the output shaft 88 and the second bristles 92 abuts the sole 84 of the respective shoe 14. The set of second bristles 92 is arranged into an annular ring which surrounds the set of first bristles 90. Additionally, each of the set of second bristles 92 is comprised of a resiliently bendable material to scrub the sole 84 of the respective shoe 14 when the first motor 86 is turned on.

The plurality of basal scrubbers 82 is arranged into a pair of rows 94 which each extends along a substantial length of the dividing wall 20. Furthermore, each of the plurality of slots 22 in the dividing wall 20 is elongated and the plurality of slots 22 is arranged in a plurality of rows 96 that are staggered with respect to the rows 94 of basal scrubbers 82. A plurality of lateral scrubbers 98 is provided and each of the lateral scrubbers 98 is movably integrated into the washing box 12 to abut a respective one of the pair of shoes 14 when the pair of shoes 14 are placed into the washing box 12. Each of the plurality of lateral scrubbers 98 is actuatable into a scrubbing condition to scrub the pair of shoes 14. The plurality of lateral scrubbers 98 includes a pair of sets of lateral scrubbers 100 that is each integrated into a respective one of a first lateral side 102 and a second lateral side 104 of the perimeter wall 18 of the washing box 12.

Each of the plurality of lateral scrubbers 98 comprises a second motor 106 that is integrated into the perimeter wall 18 of the washing box 12 such that an output 108 of the second motor 106 is directed into an interior of the washing box 12. The second motor 106 rotates in a first direction when the second motor 106 is turned on. A set of third bristles 110 is coupled to the output 108 of the second motor 106 to abut a lateral side 112 of the sole 84 of a respective one of the shoes 14. Each of the third bristles 110 is comprised of a resiliently deformable material to scrub the lateral side 112 of the sole 84 of the respective shoe 14 when the second motor 106 is turned on.

A plurality of blowers 114 is provided and each of the plurality of blowers 114 is fluidly integrated into the washing box 12 to blow air into the washing box 12 for drying the shoes 14. Each of the plurality of blowers 114 is integrated into a back side 116 of the perimeter wall 18 of the washing box 12 and the plurality of blowers 114 is arranged in a row 118 extending laterally across the back side 116. Each of the blowers 114 may comprise an electric motor and a fan driven by the electric motor. A control touch screen 120 is integrated into the front side of the perimeter wall 18 of the washing box 12 such that the control touch screen 120 can be manipulated by a user. The control touch screen 120 is in communication with each of the plurality of basal scrubbers 82 and each of the plurality of lateral scrubbers 98 for turning the plurality of basal scrubbers 82 and the plurality of lateral scrubbers 98 on and off.

A control circuit 122 is integrated into the washing box 12 and the control circuit 122 is electrically coupled to the control touch screen 120, the first motor 86 associated with each of the basal scrubbers 82, the second motor 106 associated with each of the lateral scrubbers 98, the pair of lid actuators 62, the pump 76, the plurality of blowers 114 and the motion sensor 64. The control circuit 122 includes an electronic memory 123 which stores a database comprising a plurality of operational subroutines for the pump 76, the basal scrubbers 82, the lateral scrubbers 98 and the blowers 114. The control touch screen 120 displays indicia comprising a graphical user interface for selecting one of the operational subroutines.

A timer touch screen 124 is integrated into the front side of the perimeter wall 18 of the washing box 12 such that the timer touch screen 124 can be manipulated by the user. The timer touch screen 124 is electrically coupled to the control circuit 122. The control circuit 122 includes an electronic timer 126 and the timer touch screen 124 displays indicia comprising numbers which display a time remaining for a duration of time that is being counted down by the electronic timer 126. The timer touch screen 124 may comprise a light emitting diode display or other type of electronic display.

A plurality of rollers 128 is provided and each of the plurality of rollers 128 is pivotally attached to the washing box 12. The plurality of rollers 128 is positionable in a deployed position to facilitate the plurality of rollers 128 to roll along the support surface 38 and the rollers 128 are positionable in a stored position. Each of the plurality of rollers 128 includes a leg 130 that is pivotally coupled to the bottom surface 36 of the bottom wall 16 of the washing box 12 and a wheel 132 that is rotatably disposed on the leg 130 at a point located adjacent to a distal end 134 of the leg 130. The wheel 132 has a rotational axis which is perpendicularly oriented with the leg 130 and each of the plurality of rollers 128 is positioned proximate a respective one of four corners 136 of the bottom wall 16. Furthermore, the leg 130 associated with each of the plurality of rollers 128 is directed toward a centerline of the bottom wall 16 when the plurality of rollers 128 is in the stored position.

A pair of stands 138 is each pivotally attached to the washing box 12. Each of the pair of stands 138 is positionable in a deployed position to support the washing box 12 above the support surface 38 and each of the pair of stands 138 is positionable in a stored position. Each of the pair of stands 138 includes a central member 140 which extends between a pair of outward members 142 that are perpendicularly oriented with the central member 140. A distal end 144 of each of the outward members 142 of each of the pair of stands 138 is pivotally attached to the bottom surface 36 of the bottom wall 16 of the washing box 12. Each of the pair of stands 138 is positioned between a respective pair of the plurality of rollers 128 having the central member 140 associated with each of the pair of stands 138 being oriented parallel with a respective one of the first lateral side 102 and the second lateral side 104 of the perimeter wall 18 of the washing box 12.

A power supply 146 is integrated into the washing box 12 and the power supply 146 is electrically coupled to the control circuit 122. The power supply 146 comprises a rechargeable battery 148 that is integrated into the washing box 12 and the rechargeable battery 148 is electrically coupled to the control circuit 122. The power supply 146 includes a charge port 150 that is recessed into the perimeter wall 18 of the washing box 12 for insertably receiving a charge cord 152. The charge port 150 is electrically coupled to the rechargeable battery 148 for charging the rechargeable battery 148.

In use, the lids 48 are urged into the open position when the motion sensor 64 senses motion to facilitate the pair of shoes 14 to be placed in the washing box 12. The lids 48 are urged closed after a predetermined duration of time and the control touch screen 120 is touched to select a washing cycle. Each of the basal scrubbers 82 and each of the lateral scrubbers 98 wash the sole 84 of the shoes 14 while the pump 76 urges water 17 and detergent 72 into the washing box 12 to enhance cleaning the shoes 14. The blowers 114 are turned on once the washing cycle is complete to dry the shoes 14 and the lids 48 are urged into the open position once the blowers 114 are turned off. In this way the shoes 14 can be automatically cleaned after being worn outside. The drawer 40 can be removed from the washing box 12 to facilitate the dirty water 17 and detergent 72 to be emptied from the drawer 40 when the shoes 14 are finished being cleaned.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A footwear washing assembly for automatically washing a pair of shoes, said assembly comprising:

a washing box being configured to insertably receive a pair of shoes, said washing box having a fluid compartment being integrated into said washing box wherein said fluid compartment is configured to receive a fluid that is introduced into said washing box for washing the pair of shoes;

a pair of lids, each of said lids being pivotally attached to said washing box, each of said pair of lids being positionable between a closed position and an open position;

a water reservoir being attached to said washing box wherein said water reservoir is configured to contain water for washing the shoes in said washing box;

a detergent reservoir being attached to said washing box wherein said detergent reservoir is configured to contain detergent for washing the shoes in said washing box;

a plurality of basal scrubbers, each of said plurality basal scrubbers being movably integrated into said washing box wherein said plurality of basal scrubbers is configured to have the shoes positioned on top of said plurality of basal scrubbers when the shoes are positioned in said washing box, said plurality of basal scrubbers being actuatable into a scrubbing condition wherein said plurality of basal scrubbers is configured to scrub a sole of the shoes;

a plurality of lateral scrubbers, each of said lateral scrubbers being movably integrated into said washing box wherein said plurality of lateral scrubbers is configured to abut a respective one of the pair of shoes when the pair of shoes are placed into said washing box, each of said plurality of lateral scrubbers being actuatable into a scrubbing condition wherein said plurality of lateral scrubbers is configured to scrub the pair of shoes;

a plurality of rollers, each of said plurality of rollers being pivotally attached to said washing box, said plurality of rollers being positionable in a deployed position wherein said plurality of rollers is configured to roll along the support surface, said plurality of rollers being positionable in a stored position; and a pair of stands, each of said pair of stands being pivotally attached to said washing box, each of said pair of stands being positionable in a deployed position wherein said pair of stands is configured to support said washing box above the support surface, each of said pair of stands being positionable in a stored position.

2. The assembly according to claim 1, wherein said washing box has a bottom wall and a perimeter wall extending upwardly from said bottom wall, said washing box having a dividing wall being spaced from and being oriented parallel to said bottom wall such that said dividing wall defines said fluid compartment between said dividing wall and said bottom wall, said dividing wall having a plurality of slots extending through said dividing wall wherein said plurality of slots is configured to drain the fluid into said fluid compartment, said perimeter wall having a drawer opening extending into said fluid compartment.

3. The assembly according to claim 2, wherein said washing box has a tray extending laterally away from said perimeter wall of said washing box, said tray having a water input and a detergent input each being integrated into a top surface of said tray.

4. The assembly according to claim 3, wherein:

said water reservoir is in fluid communication with said water input on said top surface of said tray such wherein said water input is configured to receive the water from said water reservoir; and said detergent reservoir being in fluid communication with said detergent input on said top surface of said tray wherein said detergent input is configured to receive the detergent from said detergent reservoir.

5. The assembly according to claim 2, wherein said washing box has a lip extending downwardly from a bottom surface of said bottom wall wherein said lip is configured to rest on a support surface when said washing box is positioned on the support surface, said lip being aligned with said perimeter wall having said lip surrounding said bottom wall.

6. The assembly according to claim 2, further comprising a drawer being slidable into said drawer opening in said perimeter wall of said washing box thereby facilitating said drawer to be positioned in said fluid compartment wherein said drawer is configured to capture the water that drains through said dividing wall, said drawer being removable from said drawer opening wherein said drawer is configured to facilitate the water to be emptied from said drawer.

7. The assembly according to claim 2, wherein each of said pairs of lids has a bottom edge intersecting a front edge at a perpendicular angle and an outer surface being concavely arcuate with respect to said bottom edge such that each of said pair of lids defines a half-shell, said bottom edge of each of said pair of lids being hingedly coupled to a top edge of said perimeter wall of said washing box at a point located at an intersection with said outer surface of said lids, said bottom surface of each of said pair of lids resting on said top edge of said perimeter wall having said front edge of each of said pair of lids abutting each other when said pair of lids are closed, said bottom edge of each of said pair of lids extending upwardly from said top edge of said perimeter wall when said pair of lids are opened.

8. The assembly according to claim 7, further comprising a pair of handles, each of said handles being attached to a respective one of said pair of lids to facilitate said washing box to be carried, each of said handles including a grip being spaced from said outer surface of said respective lid thereby facilitating said grip to be gripped, said grip associated with each of said handles being oriented parallel with said front edge of said respective lid.

9. The assembly according to claim 7, further comprising a pair of lid actuators, each of said lid actuators being integrated into said perimeter wall of said washing box, each of said lid actuators being in mechanical communication with said bottom edge of a respective one of said lids, each of said lid actuators being actuatable into an opening condition for urging said pair of lids into an open position, each of said lid actuators being actuatable into a closing condition for urging said pair of lids into a closed position.

10. The assembly according to claim 9, further comprising a motion sensor being integrated into said perimeter wall of said washing box wherein said motion sensor is configured to sense motion near said washing box, said motion sensor being electrically coupled to each of said pair of lid actuators, each of said lid actuators being actuated into said opening condition when said motion sensor senses motion wherein said motion sensor is configured to facilitate the pair of shoes to be placed into said washing box, each of said pair of lid actuators being actuated into said closing condition a pre-determined duration of time after said pair of lid actuators is actuated into said opening condition.

11. The assembly according to claim 2, wherein each of said plurality of basal scrubbers comprises:

a first motor being integrated into said dividing wall of said washing box such that an output shaft of said first motor extends upwardly from said dividing wall, said first motor rotating in a first direction when said first motor is turned on;

a set of first bristles being coupled to said output shaft wherein said set of first bristles is configured to abut the sole of a respective shoe, each of said set of first bristles being comprised of a rigid material wherein said set of first bristles is configured to dislodge mud and rocks from the sole of the respective shoe when said first motor is turned on; and a set of second bristles being coupled to said output shaft wherein said set of second bristles is configured to abut the sole of the respective shoe, said set of second bristles being arranged into an annular ring surrounding said set of first bristles, each of said set of second bristles being comprised of a resiliently bendable material wherein said set of second bristles is configured to scrub the sole of the respective shoe when said first motor is turned on.

12. The assembly according to claim 11, wherein each of said plurality of lateral scrubbers comprises:

a second motor being integrated into said perimeter wall of said washing box such that an output of said second motor is directed into an interior of said washing box, said second motor rotating in a first direction when said second motor is turned on; and a set of third bristles being coupled to said output of said second motor wherein said set of third bristles is configured to abut a lateral side of the sole of a respective one of the shoes, each of said third bristles being comprised of a resiliently deformable material wherein said set of third bristles is configured to scrub the lateral side of the sole of the respective shoe when said second motor is turned on.

13. The assembly according to claim 12, further comprising:

a control touch screen being integrated into said front side of said perimeter wall of said washing box wherein said control touch screen is configured to be manipulated by a user, said control touch screen being in communication with each of said plurality of basal scrubbers and each of said plurality of lateral scrubbers for turning said plurality of basal scrubbers and said plurality of lateral scrubbers on and off;

a control circuit being integrated into said washing box, said control circuit being electrically coupled to said control touch screen and said first motor associated with each of said basal scrubbers and said second motor associated with each of said lateral scrubbers and said pair of lid actuators and said motion sensor, said control circuit including an electronic memory storing a database comprising a plurality of operational subroutines for said pump and said basal scrubbers and said lateral scrubbers, said control touch screen displaying indicia comprising a graphical user interface for selecting one of said operational subroutines, said control circuit including an electronic timer; and a timer touch screen being integrated into said front side of said perimeter wall of said washing box wherein said timer touch screen is configured to be manipulated by the user, said timer touch screen being electrically coupled to said control circuit, said timer touch screen displaying indicia comprising numbers displaying a time remaining for a duration of time being counted down by said electronic timer.

14. The assembly according to claim 1, wherein said plurality of lateral scrubbers includes a pair of sets of lateral scrubbers each being integrated into a respective one of a first lateral side and a second lateral side of a perimeter wall of said washing box.

15. The assembly according to claim 1, further comprising a plurality of blowers, each of said plurality of blowers being fluidly integrated into said washing box wherein said plurality of blowers is configured to blow air into said washing box for drying the shoes, each of said plurality of blowers being integrated into a back side of a perimeter wall of said washing box, said plurality of blowers being arranged in a row extending laterally across said back side.

16. The assembly according to claim 1, wherein each of said plurality of rollers includes a leg being pivotally coupled to a bottom surface of a bottom wall of said washing box and a wheel being rotatably disposed on said leg at a point located adjacent to a distal end of said leg, said wheel having a rotational axis being perpendicularly oriented with said leg, each of said plurality of rollers being positioned proximate a respective one of four corners of said bottom wall, said leg associated with each of said plurality of rollers being directed toward a centerline of said bottom wall when said plurality of rollers is in said stored position.

17. The assembly according to claim 1, wherein each of said pair of stands includes a central member extending between a pair of outward members being perpendicularly oriented with said central member, a distal end of each of said outward members of each of said pair of stands being pivotally attached to a bottom surface of a bottom wall of said washing box, each of said pair of stands being positioned between a respective pair of said plurality of rollers having said central member associated with each of said pair of stands being oriented parallel with a respective one of said first lateral side and said second lateral side of said perimeter wall of said washing box.

18. A footwear washing assembly for automatically washing a pair of shoes, said assembly comprising:

a washing box being configured to insertably receive a pair of shoes, said washing box having a fluid compartment being integrated into said washing box wherein said fluid compartment is configured to receive a fluid that is introduced into said washing box for washing the pair of shoes, said washing box having a bottom wall and a perimeter wall extending upwardly from said bottom wall, said washing box having a dividing wall being spaced from and being oriented parallel to said bottom wall such that said dividing wall defines said fluid compartment between said dividing wall and said bottom wall, said dividing wall having a plurality of slots extending through said dividing wall wherein said plurality of slots is configured to drain the fluid into said fluid compartment, said washing box having a tray extending laterally away from said perimeter wall of said washing box, said tray having a water input and a detergent input each being integrated into a top surface of said tray, said perimeter wall having a drawer opening extending into said fluid compartment, said washing box having a lip extending downwardly from a bottom surface of said bottom wall wherein said lip is configured to rest on a support surface when said washing box is positioned on the support surface, said lip being aligned with said perimeter wall having said lip surrounding said bottom wall;

a drawer being slidable into said drawer opening in said perimeter wall of said washing box thereby facilitating said drawer to be positioned in said fluid compartment wherein said drawer is configured to capture the water that drains through said dividing wall, said drawer being removable from said drawer opening wherein said drawer is configured to facilitate the water to be emptied from said drawer;

a pair of lids, each of said lids being pivotally attached to said washing box, each of said pair of lids being positionable between a closed position and an open position, each of said pair of lids having a bottom edge intersecting a front edge at a perpendicular angle and an outer surface being concavely arcuate with respect to said bottom edge such that each of said pair of lids defines a half-shell, said bottom edge of each of said pair of lids being hingedly coupled to a top edge of said perimeter wall of said washing box at a point located at an intersection with said outer surface of said lids, said bottom surface of each of said pair of lids resting on said top edge of said perimeter wall having said front edge of each of said pair of lids abutting each other when said pair of lids are closed, said bottom edge of each of said pair of lids extending upwardly from said top edge of said perimeter wall when said pair of lids are opened;

a pair of handles, each of said handles being attached to a respective one of said pair of lids to facilitate said washing box to be carried, each of said handles including a grip being spaced from said outer surface of said respective lid thereby facilitating said grip to be gripped, said grip associated with each of said handles being oriented parallel with said front edge of said respective lid;

a pair of lid actuators, each of said lid actuators being integrated into said perimeter wall of said washing box, each of said lid actuators being in mechanical communication with said bottom edge of a respective one of said lids, each of said lid actuators being actuatable into an opening condition for urging said pair of lids into an open position, each of said lid actuators being actuatable into a closing condition for urging said pair of lids into a closed position;

a motion sensor being integrated into said perimeter wall of said washing box wherein said motion sensor is configured to sense motion near said washing box, said motion sensor being electrically coupled to each of said pair of lid actuators, each of said lid actuators being actuated into said opening condition when said motion sensor senses motion wherein said motion sensor is configured to facilitate the pair of shoes to be placed into said washing box, each of said pair of lid actuators being actuated into said closing condition a pre-determined duration of time after said pair of lid actuators is actuated into said opening condition;

a water reservoir being attached to said washing box wherein said water reservoir is configured to contain water for washing the shoes in said washing box, said water reservoir being in fluid communication with said water input on said top surface of said tray wherein said water input is configured to receive the water from said water reservoir;

a detergent reservoir being attached to said washing box wherein said detergent reservoir is configured to contain detergent for washing the shoes in said washing box, said detergent reservoir being in fluid communication with said detergent input on said top surface of said tray wherein said detergent input is configured to receive the detergent from said detergent reservoir;

a pump being integrated into said washing box, said pump having a pair of inputs and an output extending into an interior of said washing box, each of said inputs of said pump being fluidly coupled to a respective one of said water input and said detergent input in said tray wherein said pump is configured to spray the water and the detergent outwardly through said output of said pump and into said washing box;

a plurality of basal scrubbers, each of said plurality basal scrubbers being movably integrated into said washing box wherein said plurality of basal scrubbers is configured to have the shoes positioned on top of said plurality of basal scrubbers when the shoes are positioned in said washing box, said plurality of basal scrubbers being actuatable into a scrubbing condition wherein said plurality of basal scrubbers is configured to scrub a sole of the shoes, each of said plurality of basal scrubbers comprising:

a first motor being integrated into said dividing wall of said washing box such that an output shaft of said first motor extends upwardly from said dividing wall, said first motor rotating in a first direction when said first motor is turned on;

a set of first bristles being coupled to said output shaft wherein said set of first bristles is configured to abut the sole of a respective shoe, each of said set of first bristles being comprised of a rigid material wherein said set of first bristles is configured to dislodge mud and rocks from the sole of the respective shoe when said first motor is turned on; and a set of second bristles being coupled to said output shaft wherein said set of second bristles is configured to abut the sole of the respective shoe, said set of second bristles being arranged into an annular ring surrounding said set of first bristles, each of said set of second bristles being comprised of a resiliently bendable material wherein said set of second bristles is configured to scrub the sole of the respective shoe when said first motor is turned on;

wherein said plurality of basal scrubbers is arranged in a pair of rows each extending along a substantial length of said dividing wall;

wherein each of said plurality of slots in said dividing wall is elongated, said plurality of slots being arranged in a plurality of rows being staggered with respect to said rows of basal scrubbers;

a plurality of lateral scrubbers, each of said lateral scrubbers being movably integrated into said washing box wherein said plurality of lateral scrubbers is configured to abut a respective one of the pair of shoes when the pair of shoes are placed into said washing box, each of said plurality of lateral scrubbers being actuatable into a scrubbing condition wherein said plurality of lateral scrubbers is configured to scrub the pair of shoes, said plurality of lateral scrubbers including a pair of sets of lateral scrubbers each being integrated into a respective one of a first lateral side and a second lateral side of said perimeter wall of said washing box, each of said plurality of lateral scrubbers comprising:

a second motor being integrated into said perimeter wall of said washing box such that an output of said second motor is directed into an interior of said washing box, said second motor rotating in a first direction when said second motor is turned on; and a set of third bristles being coupled to said output of said second motor wherein said set of third bristles is configured to abut a lateral side of the sole of a respective one of the shoes, each of said third bristles being comprised of a resiliently deformable material wherein said set of third bristles is configured to scrub the lateral side of the sole of the respective shoe when said second motor is turned on;

a plurality of blowers, each of said plurality of blowers being fluidly integrated into said washing box wherein said plurality of blowers is configured to blow air into said washing box for drying the shoes, each of said plurality of blowers being integrated into a back side of said perimeter wall of said washing box, said plurality of blowers being arranged in a row extending laterally across said back side;

a control touch screen being integrated into said front side of said perimeter wall of said washing box wherein said control touch screen is configured to be manipulated by a user, said control touch screen being in communication with each of said plurality of basal scrubbers and each of said plurality of lateral scrubbers for turning said plurality of basal scrubbers and said plurality of lateral scrubbers on and off;

a control circuit being integrated into said washing box, said control circuit being electrically coupled to said control touch screen and said first motor associated with each of said basal scrubbers and said second motor associated with each of said lateral scrubbers and said pair of lid actuators and said motion sensor, said control circuit including an electronic memory storing a database comprising a plurality of operational subroutines for said pump and said basal scrubbers and said lateral scrubbers, said control touch screen displaying indicia comprising a graphical user interface for selecting one of said operational subroutines, said control circuit including an electronic timer;

a timer touch screen being integrated into said front side of said perimeter wall of said washing box wherein said timer touch screen is configured to be manipulated by the user, said timer touch screen being electrically coupled to said control circuit, said timer touch screen displaying indicia comprising numbers displaying a time remaining for a duration of time being counted down by said electronic timer;

a plurality of rollers, each of said plurality of rollers being pivotally attached to said washing box, said plurality of rollers being positionable in a deployed position wherein said plurality of rollers is configured to roll along the support surface, said plurality of rollers being positionable in a stored position, each of said plurality of rollers including a leg being pivotally coupled to said bottom surface of said bottom wall of said washing box and a wheel being rotatably disposed on said leg at a point located adjacent to a distal end of said leg, said wheel having a rotational axis being perpendicularly oriented with said leg, each of said plurality of rollers being positioned proximate a respective one of four corners of said bottom wall, said leg associated with each of said plurality of rollers being directed toward a centerline of said bottom wall when said plurality of rollers is in said stored position;

a pair of stands, each of said pair of stands being pivotally attached to said washing box, each of said pair of stands being positionable in a deployed position wherein said pair of stands is configured to support said washing box above the support surface, each of said pair of stands being positionable in a stored position, each of said pair of stands including a central member extending between a pair of outward members being perpendicularly oriented with said central member, a distal end of each of said outward members of each of said pair of stands being pivotally attached to said bottom surface of said bottom wall of said washing box, each of said pair of stands being positioned between a respective pair of said plurality of rollers having said central member associated with each of said pair of stands being oriented parallel with a respective one of said first lateral side and said second lateral side of said perimeter wall of said washing box; and a power supply being integrated into said washing box, said power supply being electrically coupled to said control circuit, said power supply comprising:

a rechargeable battery being integrated into said washing box, said rechargeable battery being electrically coupled to said control circuit; and a charge port being recessed into said perimeter wall of said washing box for insertably receiving a charge cord, said charge port being electrically coupled to said rechargeable battery for charging said rechargeable battery.

* * * * *